United States Patent [19]

Motta

[11] Patent Number: 4,797,998

[45] Date of Patent: Jan. 17, 1989

[54] LOCKABLE PIVOTABLE RAZOR

[75] Inventor: Vincent C. Motta, West Norwalk, Conn.

[73] Assignee: Warner-Lambert Company, Morris Plains, N.J.

[21] Appl. No.: 936,435

[22] Filed: Dec. 8, 1986

[51] Int. Cl.[4] ..... B26B 21/14

[52] U.S. Cl. ..... 30/87; 30/85

[58] Field of Search ..... 30/85, 86, 87, 89, 47

[56] References Cited

U.S. PATENT DOCUMENTS 4,026,016 5/1977 Nissen ..... 30/87 X 4,308,663 1/1982 Ciattore ..... 30/89 X 4,492,025 1/1985 Jacobsen ..... 30/87 X

*Primary Examiner*—Frank T. Yost

*Assistant Examiner*—Willmon Fridie, Jr.

*Attorney, Agent, or Firm*—Howard Olevsky

[57] ABSTRACT

According to this invention a razor is provided which features a choice between pivoting and non pivoting cartridge action due to the presence of a locking yoke which slides around a portion of the cam follower to butt against the V edges of the cartridge cam. The yoke can be manually operated and released but is always disengaged during cartridge attachment and removal.

35 Claims, 5 Drawing Sheets

61
60
63
64
62
36
32
38
37
30
36
32
35
37
41
40
46
43
47
141
48
51
45
52
59
53
49
50
54
55
56
38
57
58
150
22
26
29
23
20
28
25
27
21
24
11
13
10
14
12
140
130
122
120
130
111
121
110
100

LOCKABLE PIVOTABLE RAZOR

FIELD OF THE INVENTION

This invention relates to a handle for a pivoting razor cartridge and particularly to a handle which will allow the cartridge to pivot or not as the user chooses.

BACKGROUND OF THE INVENTION

Razors with cartridges that pivot about journal bearings linking them to razor handles via handle arms having journal attachment means are well known in the art and have been available for several years.

These pivoting razors also feature a V-shaped cam positioned between the journal bearings on the cartridge bottom; while the handle employs a biased cam follower which tracks within the V along the pivot arc and add resistance to the pivot movement. This force tends to bias the cartridge equilibrium position in which the cam follower is positioned in the middle of the V. A stop is provided at the front and at the rear end of the cartridge to define the pivot arc.

U.S. Pat. No. 4,083,104 issued Apr. 11, 1978 to Warren I Nissen et al. described such a razor.

Ideally a razor should be capable of including a pivoting or non pivoting function. The user should be able to exercise a choice. For example, non pivoting action may be preferred to trim mustache or sideburns or to shave around the nose and a single pivotable razor which could be locked in a fixed position would provide the advantages inherent in both shaving modes.

U.S. Pat. No. 4,266,340 issued May 12, 1981 to Peter Bowman describes a cam follower subassembly particularly adapted for use with a razor handle for a pivoting cartridge wherein the pusher and cam follower are maintained as a subassembly by stops which work against a compression spring. No locking means is disclosed.

U.S. Pat. No. 4,308,663 issued Jan. 5, 1982 to John F. Ciaffone describes a razor handle for a pivoting razor cartridge with locking means for restraining the cartridge at one end of the pivot cycle which is released by applying manual force greater than that encountered during shaving. This latching means is a single flexible cantilevered member extending from the handle.

U.S. Pat. No. 3,938,247 issued Feb. 17, 1976, to Carbonell describes a pivoting system with a complex bulky locking mechanism which restricts rather than stops the cartridge and employs a complex assembly in the gripping portion of a handle with a cartridge which is different than the center positioned V-cam cartridge used in pivoting razors currently.

There are other patents which teach locking and pivoting combinations in razors of different designs or for different purposes, e.g., for maintaining a blade assembly in a particular fixed position after the assembly is pivoted or assemblies which utilize other cartridges. These patents are U.S. Pat. No. 1,890,334 issued Dec. 6, 1932 to Muros; U.S. Pat. No. 4,277,302 issued to Forrance, U.S. Pat. No. 3,317,995 issued May 9, 1967 to Bord; U.S. Pat. No. 4,083,103 issued Apr. 11, 1978 to Estandion; and U.S. Pat. No. 1,694,337.

Several Japanese publications also apparently disclose the concept of locking a pivoting cartridge when attached to a handle. These are Japanese Patent application publication Nos. 103987/85; 136084/80; Japanese Utility Model Publication Nos. 151086/81; 168273/84; 165170/84; and 24270/85.

Also relevant are Japanese Utility Model Nos. 1,213,205; 1,502,533, 1,514,870; 1,539,976 and 1,624,951 published for opposition and Japanese Patent Application Nos. 4,172,978; 1,172,974; 1,178,644 published for opposition.

SUMMARY OF THE INVENTION

According to this invention a razor is provided which features a choice between pivoting and non pivoting cartridge action due to the presence of a locking yoke which slides around a portion of the cam follower to butt against the V edges of the cartridge cam. The yoke can be manually operated and released, but is always disengaged during cartridge attachment and removal.

BRIEF DESCRIPTION OF THE DRAWINGS

The invention will be more readily understood by reference to the drawings in which.

DETAILED DESCRIPTION OF THE INVENTION

Figure 1:
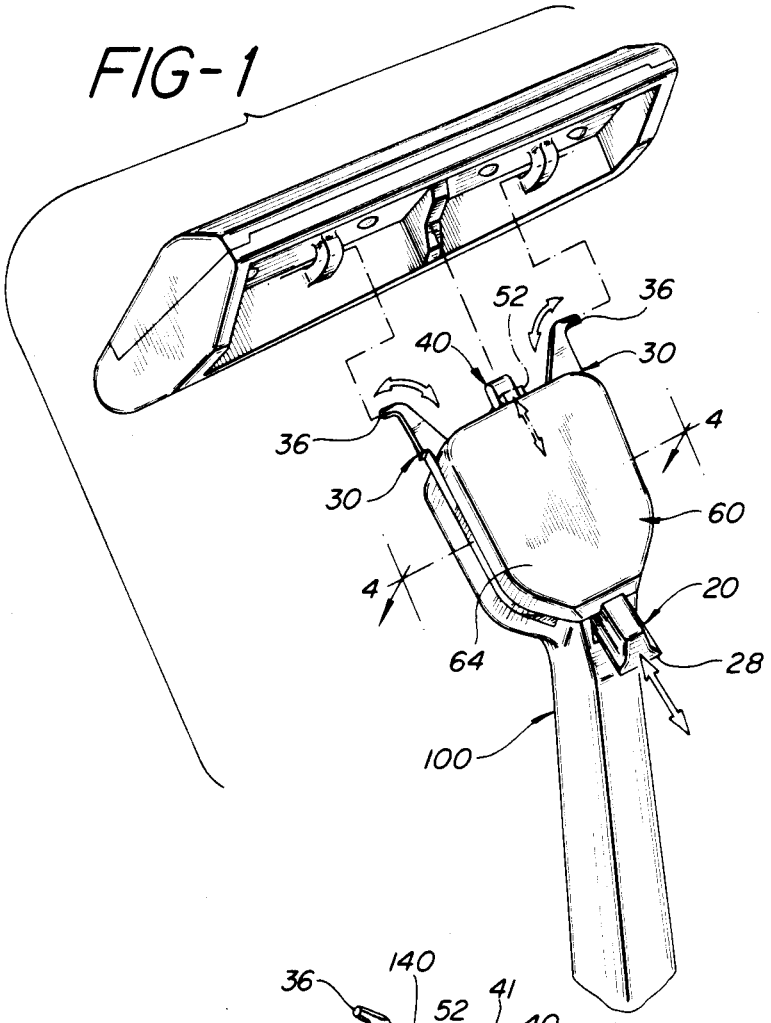
FIG. 1 is a perspective view showing the handle of this invention and a razor cartridge.

The paddle-shaped top portion of the bottom frame 100 of the razor handle of this invention is characterized by a series of specifically shaped recesses for positioning and engagement of the various parts of the locking pivoting head razor. Thus, lever receiving recess 110 is a circular indentation with a secondary arcuate recess 111 designed to receive circular cam 10 and lever finger 11 respectively Y-shaped recess 120 is designed to receiver pusher 20 with upper and lower asymmetrically positioned pusher arms 21 and 22 positioned above and allowed to slide linearly reciprocally over edge supports 121 and 122 respectively (see also FIG. 3). Pivot nipples 130 provide pivot points for pivoting cartridge engaging arms 30 through circular pivot openings 32.

Figure 4:
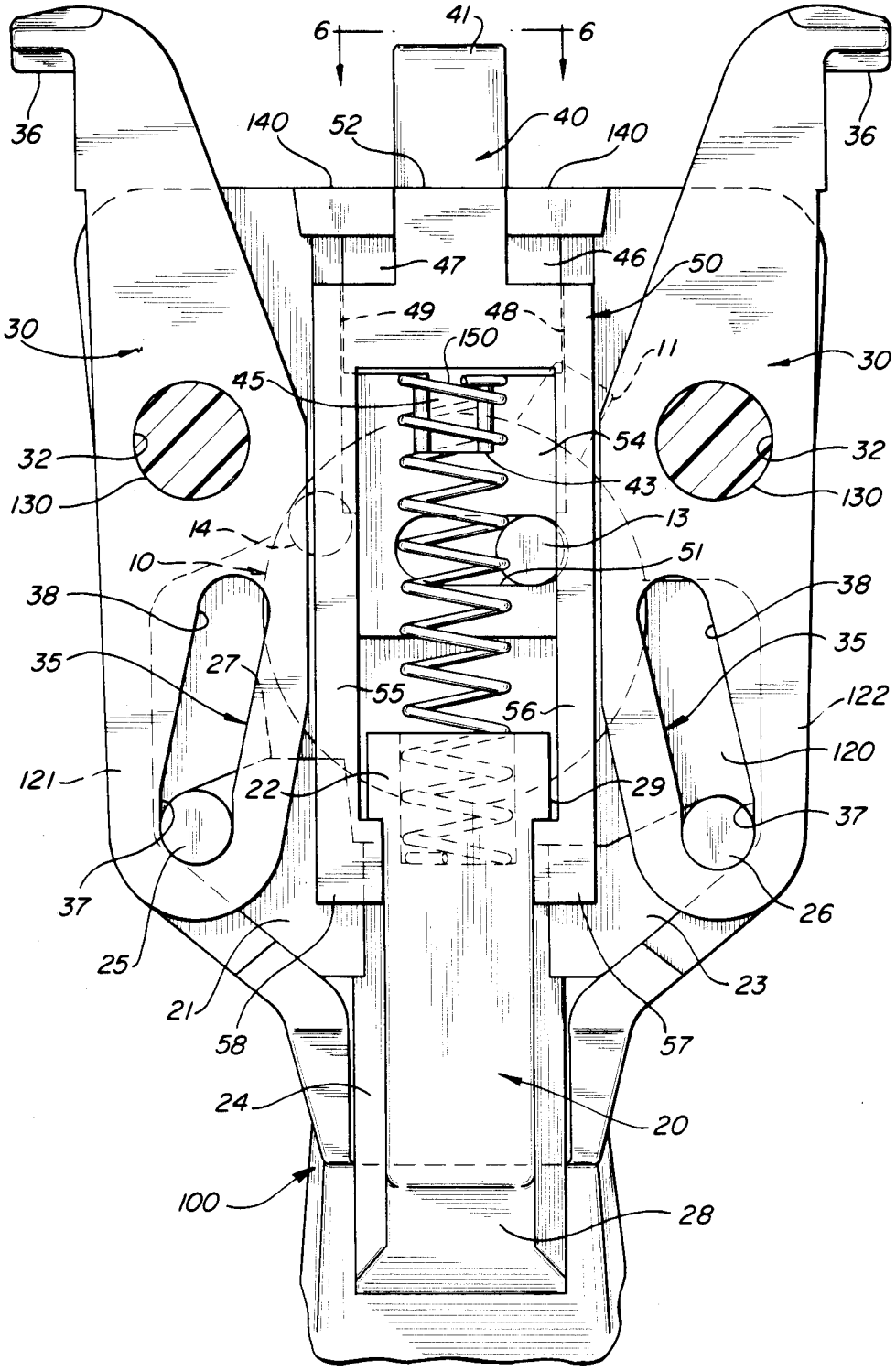
FIG. 4 is a top plan view of the handle with the top plate removed, taken along line 4—4 of FIG. 1.
Figure 5:
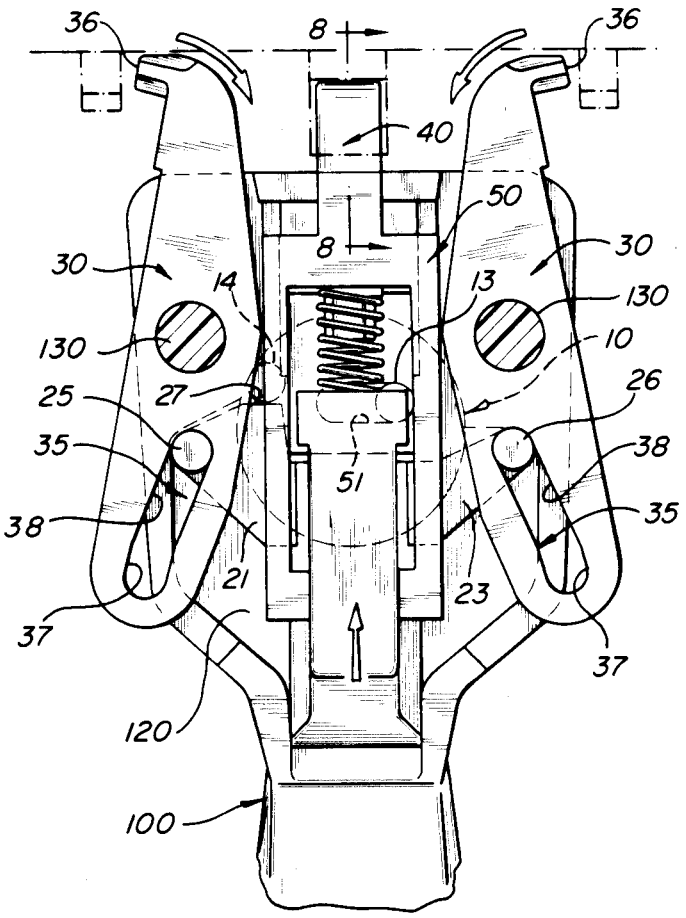
FIG. 5 is a view similar to FIG. 4 but with the pivot arms in the engage/disengage position and also showing relative parts of the cartridge shown in phantom lines.
Figure 6:
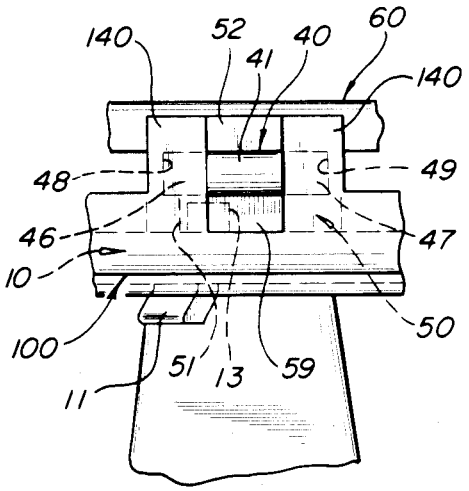
FIGS. 6 is a front elevational view of the locking tabs taken along view line 6—6 of FIG. 4.

Turning now to FIGS. 4, 5 and 6 stops 140 form a front face of the bottom of the razor handle body 100 and limit the forward movement of the cam follower 40.

The individual components of the razor handle will now be described as well as their relationship to each other and the pivoting and locking association with a blade cartridge.

Figure 2:
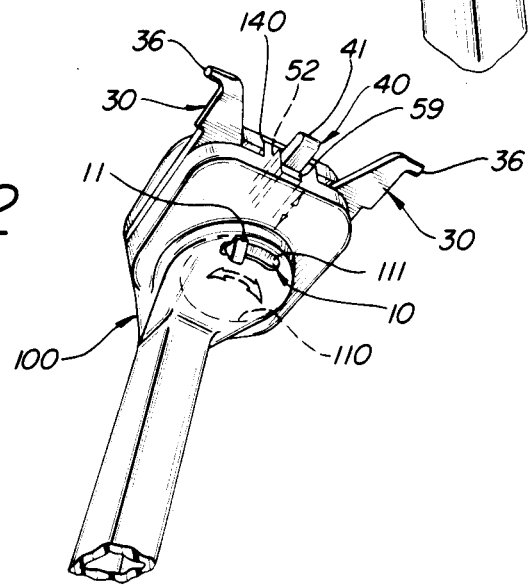
FIG. 2 is a perspective view showing the underside of the assembly.
Figure 7:
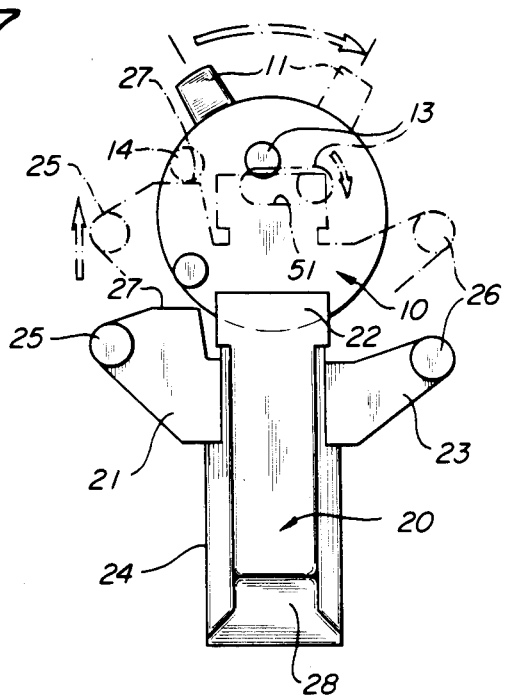
FIG. 7 is a schematic top plan view with certain parts removed for clarity showing the relationship between the cam lever and pusher subassembly.

First, circular cam 10 which nests in circular cam receiving area 110, with finger 11 is attached to the bottom surface 12 of the circular body and able to move through the arc defined by slot 11 and extending through it (see FIGS. 2, 4 and 7). Projection 13 of cam lever 10 projects upward and fits within slot 51 of lock tab 50 which is positioned over circular cam 10. Lock tab 50 will be moved forward as the finger 11 of circular cam 10 is pushed to rotate circular cam 10 in a counterclockwise direction. The lock tab 50, as best seen by reference to FIG. 3 and 4, has a slot 141 extending within bridge 53 between tabs 52 and 59. Legs 55, 56 extend from the bridge 53, and cross piece 54 bridges the legs about midway along their length and includes a slot 51. At the bottom of the legs 55, 56 shoulders 57 and 58 extend inward to provide a rear stop for pusher stop 22.

Figure 3:
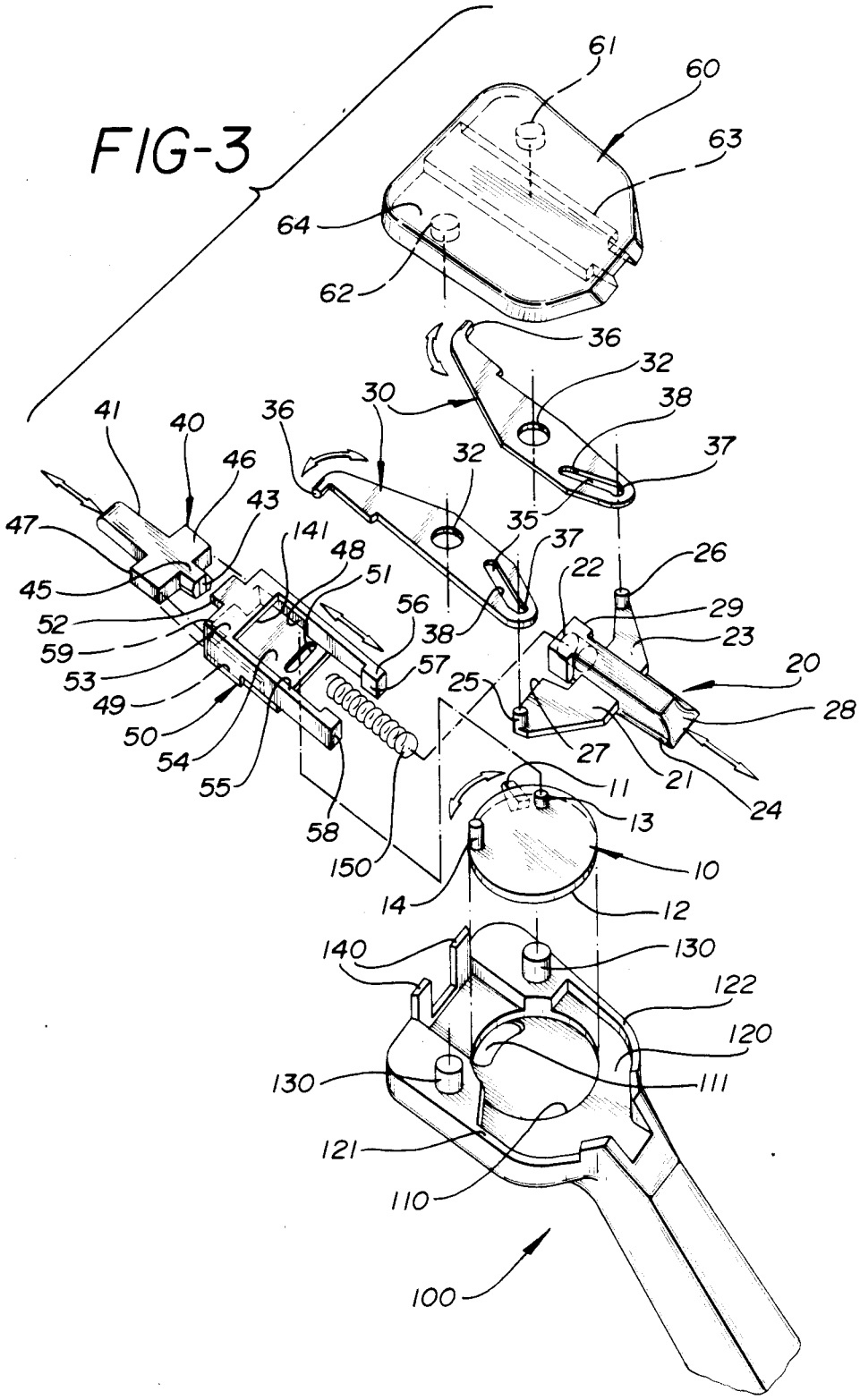
FIG. 3 is an exploded perspective view showing the order of assembly and operative relationships of the components of the handle of the invention.

As can be seen from reference to FIGS. 3, 4, 5 and 6, the cam follower flanges 46 and 47 slideably engage the slots 48, 49 positioned on the inner surface of legs 55, 56 and bias against pusher stop 22. As best seen in FIG. 3, pusher stop 22 is a cylindrical recess which engages and restrains a compression spring 150. Extending from bridge 53 arc arms 52 and 59 which form a yoke positioned above and below cam follower finger 41 which is reciprocally moveable through slot 141. Tabs 52 and 59 and cam follower finger 41 can pass through the opening defined by stops 14 while the stop restrains the cam follower 40 at flanges 46 and 47. When no cartridge is engaged the flanges 46, 47 abut stops 140, but when a cartridge is attached the cam follower biased backward against pusher stop 22 and the flanges are spaced from stop 40.

Pusher 20 has arms 21, 23 asymmetrically positioned along pusher shaft 24. Pusher arm 21 positioned farther forward than pusher arm 23 and includes camming surface 27. Each pusher arm includes nipples 25, 26 which engage pivot arms 30 via eccentric pivot slot 35 with the nipple parallel and symmetrical with respect to the longitudinal axis of pusher 20 and projection 130 and 140.

Pivot arms 30 also have journal means 36 for engaging journal bearings on the bottom of a pivoting blade assembly cartridge (see FIGS. 1 and 5).

Top frame 60, as shown in FIGS. 1 and 3 has a flat body 64 facing upward, recesses 61, 62 for mating engagement with pivot nipples 130, 140 so that pivot arms 30 can rotate freely. A trough 63 is also provided on the underside of top frame 50 to allow reciprocal linear movement of lock tab 50 and pusher 20, and maintains the relative position of legs 55, 56 thereby preventing disengagement of pusher stop 22.

OPERATION

Figure 8:
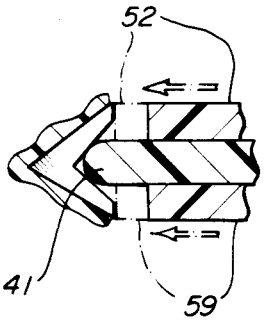
FIG. 8 is a cross-sectional view showing the cam follower in the pivoting position as taken along line 8—8 of FIG. 5, the locked position being shown in phantom lines.

When the blade assembly cartridge is engaged by the handle as can be seen in FIGS. 1, 5 and 8, pivot arms 30 attached to bottom frame 100 by cylindrical projections 130 and engage the journal bearings of the razor cartridge via journal arms 36. Cam follower 40 is biased against the V-shaped cam of the bottom of the pivoting blade assembly to provide resistance to the free pivoting action of the journal bearing assembly.

When the user desires to eliminate the pivoting action of the cartridge, he rotates cam lever 10 counterclockwise by pushing against lever finger 11 extending through bottom frame 100. This moves projection 13 against slot 51 of lock tab 50. This action results in sliding tabs 52, 59 forward through the frame opening defined by stops 140 and into abutment with the ends of the V-cam on the cartridge bottom (see Figs. 5 and 8).

When the user wants the razor head to pivot, the lever finger 11 is rotated clockwise which reverses the movement of the parts described immediately above and removes the yoke from the V-cam ends.

One of the unique features of this razor handle is that it always returns to the unlocked or pivot mode when a cartridge is released and/or a new cartridge attached. The relationship between pusher and circular cam is shown in FIG. 7 with the circular cam shown in the locked position. When the handle is in a locked position projection 14 of cam lever 10 is in a 8:00 position relative to the face of the circular body 12. When thumb rest 28 of pusher 20 is pushed, the entire pusher, including nipples 25 and 26 of arms 21 and 23 respectively moves forward linearly. Initially, nipples 25 and 26 slide forward in eccentric slots 35 of arms 30 engaging only sides 37 which are parallel to the razor body 100. This movement compresses the biasing spring but does not cause arms 30 to pivot. Also, and most importantly, because the entire pusher unit moves during the locking operation, this linear movement within track 35 is needed to obtain locking without movement of arms 30.

Pusher cam surface 27 bears against circular lever projection 14 displacing it arcuately in a clockwise direction. This action pushes projection 13 against the bottom of lock tab slot 51 forcing the lock tab 50 backward and withdrawing yoke tabs 52, 59 from their advanced position. The cartridge is now pivotable again with only the cam follower 40 in contact with the V-cam. It should be noted that the biasing action of the spring 150 acts to return a partially rotated circular cam 10 to its original position until circular cam is half completed, i.e., about 12:00 after rotation exceeds half of its path biasing drives the lever toward completion of its arc. It is this feature which maintains the cartridge either in the pivoting or locked mode.

With the cartridge pivotable, the nipples 25, 26 continue forward up the slot 35 until they bear against angled slot section 38 which moves the pivot arms inward ultimately disengaging the journal arms from the cartridge journal bearings and releasing the cartridge.

After the cartridge is released and manual pressure against pusher 20 is discontinued, the pusher returns to its original position due to its being biased against the cam follower 40. During return, the path of nipples 25 and 26 is reversed, moving outwardly angularly and then linearly. This action returns pivot arms 30 to its original position with journal arms 36 extending outward at their widest position.

If the lock is activated so that tabs 52 and 59 are advanced through the area defined by stop 140 in the razor handle body, i.e, the lower finger 11 is moved counterclockwise, the lock will be disengaged prior to engaging a new cartridge. This happens because the same mechanism used to release the lock when the cartridge is released, is employed to push the fingers closer to each other to alloy for new cartridge engagement, i.e., the pusher is pushed forward. Thus, the locking handle of this invention always disengages from or is attached to cartridge in the pivoting or open mode.

While it is preferred that the handles engage the cartridge with the journals extending outward so that the handle in toto is smaller, the engagement can also be outside-in with the only modification needed being to turn the handle over so that slot 38 is directed outward and upward.

I claim:

1. A razor handle for mating with a pivotable razor cartridge comprising:

(a) a bottom frame;

(b) a top frame mated to said bottom frame;

(c) attachment means allowing pivotable movement of said cartridge in the direction of shaving in response to shaving forces on the cartridge bottom;

(d) biased cam follower means for engagement with a V-shaped cam on the cartridge bottom said cam follower, said cam follower means linearally reciprocally moveable against said bias within said frame; and (e) locking means including a slideably mounted member within said frame for preventing cartridge pivoting.

2. The handle of claim 1 wherein locking is accomplished by translating rotary motion of a rotatably mounted circular plate to linear motion.

3. The handle of claim 1 wherein the locking means includes a yoke which surrounds the cam follower means and is positioned against each end of said V-shaped cam when activated.

4. The handle according to claim 3 wherein said yoke depends forward from a bridge, said bridge having downwardly extending legs, a cross piece parallel to said bridge and having a slot parallel to said bridge positioned therein, and a pair of inwardly facing shoulders depending from the ends of said legs.

5. The handle of claim 4 wherein the inside of said locking means legs defines a track within which the cam follower moves.

6. The handle of claim 1 wherein the attachment means are pivotally mounted arms.

7. The handle of claims 1 wherein the attachment means are arms which pivot about nipples extending upward from said frame bottom.

8. The handle of claim 1 wherein said locking means include a rotatably mounted circular plate which engages said slideably mounted means and reciprocally moves said slideably mounted means when said plate is rotated.

9. The handle of claims 1 wherein a pusher member extends through said frame and is biased against said cam follower means.

10. The handle of claims 1 wherein a pusher member extends through said frame is biased against cam follower means and retained against said biasing force by stops provided by said locking means.

11. The handle of claims 1 wherein the attachment means are pivotally mounted arms said arms pivoted to engage and disengage said cartridge said arms being pivoted by movement of biased pusher means.

12. A razor handle locking means for preventing a pivotal cartridge from pivoting after attachment to a razor handle said cartridge having on its bottom surface a pair of pivotable attachment means for rotatably pivoting after attachment to a razor head in response to shaving forces and a V-shaped cam positioned between said attachment means; said razor handle having a biased cam follower with a finger for travel along said cam to restrict cartridge movement said locking means comprising a slideable yoke with one yoke arm positioned above said finger and a second yoke arm positioned below said finger said yoke arms bearing against each end of said V when the locking means is engaged.

13. A razor handle for attachment to a cartridge adopted to be pivoted when attached to said handle in response to shaving forces, said handle having a cartridge attachment arm pivotally mounted at each side, and having locking means to prevent the cartridge from pivoting, said handle having a single element operatively coupled to said arms and said locking means to allow both cartridge engagement or disengagement and release of said locking means by a single movement of said element.

14. The handle of claim 13 wherein only the locking means can be engaged and released by movement of a separate element.

15. The handle of claim 13 or 14 wherein the locking means is released and the cartridge attachment arms activated in response to pressure applied to a biased pusher.

16. A razor handle for pivoting attachment to a cartridge, said cartridge being attached to said handle by two pivoting journal arms adapted to engage two journal bearings, each said bearing positioned on the bottom near either end of said cartridge, said handle characterized by locking means which prevent rotation of said cartridge, said locking means being selectively engaged and disengaged when the cartridge is ready for shaving and disengaged during engagement and ejection of said cartridge.

17. The handle of claim 16 wherein said locking means is engaged and disengaged by linear reciprocal movement which is activated by reciprocal rotational movement of a rotatably mounted circular plate.

18. The handle of claim 17 wherein said rotational movements is through a predetermined arc.

19. The handle of claim 16 wherein the engagement and disengagement of the cartridge is activated by pusher means mechanically coupled with said arms, with said arms pivoting in response to pusher means movement.

20. The handle of claim 19 wherein said pusher means always releases said locking means when said arms are moved.

21. The handle of claim 19 wherein said pusher means include a shaft which is biased for reciprocal movement, and asymmetrically positioned arms extending outward from said shaft.

22. The handle of claim 21 wherein each of said pusher arms is mechanically coupled to a journal arm.

23. The handle of claim 22 wherein the pusher moves linearly without movement of the journal arms.

24. The handle of claim 23 wherein the linear pusher movement activates the lock release mechanism.

25. The handle of claim 23 or 24 wherein said linear pusher movement precedes pivoting movement of the journal arms prior to attachment and disengagement of said cartridge.

26. The razor of claim 22 wherein said pusher arms are provided with nipples which slide in slots formed in said journal arms.

27. The razor of claim 22 wherein said journal arm slots have a first section parallel to said pusher arm and a second section angularly disposed with respect to said first section.

28. The razor of claim 27 wherein said second section slots are inwardly angularly disposed and said journal arms pivot inward to release said cartridge, said pusher arm and a second section angularly disposed with respect to said first section.

29. A razor handle for a pivotable blade cartridge comprising in combination:

(a) a frame;

(b) journal attachment means for pivotal attachment of said handle to said blade cartridge through mating means on the bottom of the cartridge;

(c) cam follower means for engaging a V-shaped cam positioned between journal mating means on the bottom of said cartridge; and (d) releasable locking means preventing the attached cartridge from pivoting in either direction, wherein the locking means includes a yoke which surrounds said cam follower means and is positioned against each leg of said V-shaped cam when activated.

30. A razor handle for a pivotable blade cartridge comprising in combination:

(a) a frame;

(b) journal attachment means for pivotal attachment of said handle to said blade cartridge through mating means on the bottom of the cartridge;

(c) cam follower means for engaging a V-shaped cam positioned between journal mating means on the bottom of said cartridge;

(d) releasable locking means preventing said attached cartridge from pivoting in either direction, wherein the locking means includes a yoke which surrounds said cam follower and depends forward from a bridge, said bridge having downwardly extending legs the end of each leg having an inwardly facing shoulder, a cross piece bridging said legs with a slot positioned therein.

31. The handle of claim 30 wherein the inside of said locking means legs defines a track within which said cam follower means.

32. A razor handle for a pivotable blade cartridge comprising in combination:

(a) a frame;

(b) journal attachment arms pivotally attaching said handle to said cartridge by upwardly extending nipples on the bottom of said frame;

(c) cam follower means for engaging a V-shaped cam positioned between journal mating means on the bottom of said cartridge; and (d) releasable locking means preventing said attached cartridge from pivoting in either direction.

33. A razor handle for a pivotable blade cartridge comprising in combination:

(a) a frame;

(b) journal attachment means for pivotal attachment of the handle to the blade cartridge through mating means on the bottom of said cartridge;

(c) cam follower means for engaging a V-shaped cam positioned between journal mating means on the bottom of said cartridge;

(d) releasable locking means preventing the attached cartridge from pivoting in either direction; and (e) a pusher member, extending through said frame and biased against said cam follower means.

34. The handle of claim 33 wherein said pusher member is retained against said bias by stops provided by said locking means.

35. A razor handle for a pivotable blade cartridge comprising in combination:

(a) a frame;

(b) journal attachment means for pivotal attachment of the handle to said blade cartridge through mating means on the bottom of said cartridge; said attachment means being pivotally mounted arms engaging and disengaging said cartridge, said arms being pivoted by movement of biased pusher means;

(c) cam follower means for engaging a V-shaped cam positioned between journal mating means on the bottom of said cartridge; and (d) releasable locking means preventing said attached cartridge from pivoting in either direction.

* * * * *